US006186853B1

(12) United States Patent
Messina

(10) Patent No.: US 6,186,853 B1
(45) Date of Patent: Feb. 13, 2001

(54) BUBBLE MAKER WITH MECHANIZED DIPPING WAND

(76) Inventor: Gene Messina, 22 William Penn Dr., Stonybrook, NY (US) 11790

( * ) Notice: Under 35 U.S.C. 154(b), the term of this patent shall be extended for 0 days.

(21) Appl. No.: 09/320,872

(22) Filed: May 27, 1999

(51) Int. Cl.[7] ..... A63H 33/28
(52) U.S. Cl. ..... 446/15; 446/16
(58) Field of Search ..... 446/15, 16, 20, 446/21, 17, 18, 19

(56) References Cited

U.S. PATENT DOCUMENTS

| | | | | |
|---|---|---|---|---|
| Re. 32,973 | | 7/1989 | Panzarella . | |
| 589,917 | | 9/1897 | Wynne . | |
| 660,485 | | 10/1900 | Bradshaw . | |
| 1,031,764 | | 7/1912 | Wright . | |
| 2,426,895 | | 9/1947 | Neumann . | |
| 2,547,825 | | 4/1951 | King . | |
| 2,579,714 | | 12/1951 | Treuthart . | |
| 2,675,641 | | 4/1954 | Baggott . | |
| 2,736,988 | | 3/1956 | Fisher . | |
| 2,862,320 | | 12/1958 | Mayo . | |
| 2,974,438 | | 3/1961 | Hopkins . | |
| 2,987,847 | | 6/1961 | Jones . | |
| 3,093,925 | | 6/1963 | Greene . | |
| 3,100,947 | | 8/1963 | Hellman . | |
| 3,123,936 | | 3/1964 | Feltman . | |
| 3,636,652 | * | 1/1972 | Dumont | 446/15 |
| 3,745,693 | | 7/1973 | La Fata . | |
| 3,775,898 | | 12/1973 | Kallah . | |
| 3,913,260 | | 10/1975 | Corbett . | |
| 3,925,923 | | 12/1975 | La Fata . | |
| 4,044,496 | | 8/1977 | Jernstrom . | |
| 4,125,959 | | 11/1978 | Markiw . | |
| 4,133,138 | | 1/1979 | Coons . | |
| 4,276,713 | | 7/1981 | Crosbie . | |
| 4,299,049 | | 11/1981 | Pimentel et al. . | |
| 4,367,608 | | 1/1983 | Melotti . | |
| 4,447,982 | * | 5/1984 | Gushea | 446/16 |
| 4,481,731 | | 11/1984 | La Fata . | |
| 4,556,392 | * | 12/1985 | Chang | 446/16 |
| 4,576,582 | | 3/1986 | Panzarella . | |
| 4,700,965 | * | 10/1987 | Kinberg | 446/16 |
| 4,764,141 | | 8/1988 | D'Andrade . | |
| 4,770,649 | | 9/1988 | Cuccio . | |
| 4,775,348 | | 10/1988 | Collins . | |

(List continued on next page.)

FOREIGN PATENT DOCUMENTS 542579 6/1957 (CA) .

OTHER PUBLICATIONS

U.S. application No. 09/219,069, Messina et al., filed Dec. 22, 1998.

* cited by examiner

*Primary Examiner*—Sam Rimell
(74) *Attorney, Agent, or Firm*—Marshall, O'Toole, Gerstein, Murray & Borun

(57) ABSTRACT

A mechanized bubble making toy with enhanced spill resistance having a hand held housing and manually operated bubble making wand movable relative to an annularly shaped reservoir of bubble forming solution is provided. The wand and an associated ring are movable between operational and loading positions. The wand ring moves through a thin slot provided within the inner circumference of the annular reservoir to thereby limit the ability of the bubble forming solution to escape. If solution escapes, a drip gutter is provided around the inner circumference of the reservoir to direct the excess solution back to the reservoir, and if excess solution drips form the wand ring, a drip string is provided to directly communicate the solution from the wand ring to the reservoir. The reservoir includes a bay shaped to ensure both that a film of solution is formed, and that substantially all solution is used.

16 Claims, 6 Drawing Sheets

U.S. PATENT DOCUMENTS

| | | | | |
|---|---|---|---|---|
| 4,840,597 | | 6/1989 | Perez . | |
| 4,955,840 | | 9/1990 | Moomaw . | |
| 4,957,464 | * | 9/1990 | Perez | 446/16 |
| 5,078,636 | | 1/1992 | Clarke et al. . | |
| 5,156,564 | | 10/1992 | Hasegawa . | |
| 5,224,893 | | 7/1993 | Routzong et al. . | |
| 5,348,507 | * | 9/1994 | McGhie et al. | 446/16 |
| 5,366,402 | | 11/1994 | Rudell et al. . | |
| 5,462,469 | | 10/1995 | Lei . | |
| 5,478,267 | | 12/1995 | McDonald et al. . | |
| 5,520,564 | | 5/1996 | DeMars . | |
| 5,542,869 | | 8/1996 | Petty . | |
| 5,603,651 | | 2/1997 | Shure et al. . | |
| 5,613,890 | * | 3/1997 | DeMarrs | 446/15 |
| 5,620,351 | | 4/1997 | Ho . | |
| 5,620,353 | | 4/1997 | Lai . | |
| 5,643,035 | * | 7/1997 | Freese et al. | 446/15 |
| 5,695,379 | | 12/1997 | Ho . | |
| 5,704,821 | | 1/1998 | Mann . | |
| 5,839,936 | * | 11/1998 | Lin | 446/16 |
| 5,879,218 | * | 3/1999 | Tao | 446/15 |

BUBBLE MAKER WITH MECHANIZED DIPPING WAND

FIELD OF THE INVENTION

The present invention generally relates to toys, and more particularly relates to toys for making bubbles.

BACKGROUND OF THE INVENTION

Bubble making toys have captivated the interest of children for years. Such devices can be as simple as a dipstick or a wand having a ringlike structure which can be dipped into a soapy solution, and either be waved back and forth, or be blown upon to generate bubbles. More specifically, surface tension causes the soapy solution to cling to the surface of the ring, and forms a film extending across a central opening of the ring. As air is moved against that film, for example, by directing a breath of air toward the film, the film bows away from the ring, eventually escaping the ring and forming a bubble. Examples of such devices are shown in La Fata, U.S. Pat. No. 4,481,731, and Cuccio, U.S. Pat. No. 4,770,649. While such devices are functional, they are not without drawbacks, which namely manifest themselves in the form of leakage, drippage, and general messiness.

Some prior art devices have therefore attempted to distance the device from the hand of the user, to thereby avoid unpleasant drippage. For example, La Fata, U.S. Pat. No. 3,745,693, provides a bubble making toy in the form of a multiple apertured reservoir tied to a string which can be swung in a circle, and thereby utilize centrifugal force to direct the soapy solution to the apertures to form films, and the air stream generated by the swinging action to generate the actual bubbles. Such a device therefore necessarily requires a relatively large amount of space, with the user actually having relatively little control over the bubble making process.

In addition, many prior art devices have required operator input in manipulating either the wand or the bubble forming solution to create the film necessary for forming bubbles. Such manipulation often proves difficult, especially for young children, and either leads to frustration or premature play stoppage. Some devices therefore provide a somewhat automated mechanism for creating the film of soapy solution and generating bubbles. Such devices can be provided in the form of toy guns, such as that disclosed in La Fata, U.S. Pat. No. 3,925,923, DeMars U.S. Pat. No. 5,613,890, or Lei, U.S. Pat. No. 5,462,469. However, such devices are often relatively complex with parts which are prone to fatigue or failure, and are also often reliant on batteries, motors, and fans for pumping solution to a wand ring and for generating an airstream to create bubbles.

SUMMARY OF THE INVENTION

According to one aspect of the invention, a bubble maker is provided which may include a housing, a bubble forming ring and a trigger. The housing may have a substantially annular reservoir and a central opening, with the reservoir being adapted to retain bubble making solution. The bubble forming ring may be pivotally attached to the housing and be adapted to move from the reservoir to the central opening. The trigger may be operably attached to the bubble forming ring to move the bubble forming ring between the reservoir and the central opening.

In accordance with other aspects of the invention, the bubble making toy may include a spill gutter extending around an inner circumference of the housing proximate the central opening. A slot may be provided in the inner circumference of the housing to allow passage of the bubble forming ring. The bubble forming ring may include a drip string to facilitate communication of excess bubble forming solution from the ring back to the reservoir.

According to another aspect of the invention, a bubble maker is provided which may include a housing, a wand and a means for moving the wand. The housing may include a substantially annular reservoir, adapted to retain a volume of bubble making solution, and may also include a central opening. The wand may include a bubble forming ring at one end and be adapted to move from a first position in the reservoir to a second position in the central opening. The means for moving is adapted to move the wand between the first and second positions.

In another aspect, the present invention may be provided in the form of a manually operated, spill resistant bubble maker having a housing, a wand and a trigger. The housing is adapted to retain a volume of bubble making solution, while the wand includes a bubble forming end which is adapted to move from a first position in the reservoir, to a second position out of the reservoir. The trigger may be operably connected to the wand and be adapted to move the wand from the first position to the second position.

These and other features and advantages of the present invention will become more apparent from the following detailed description when taken in conjunction with the accompanying drawings.

DETAILED DESCRIPTION OF THE PREFERRED EMBODIMENT

Figure 1:
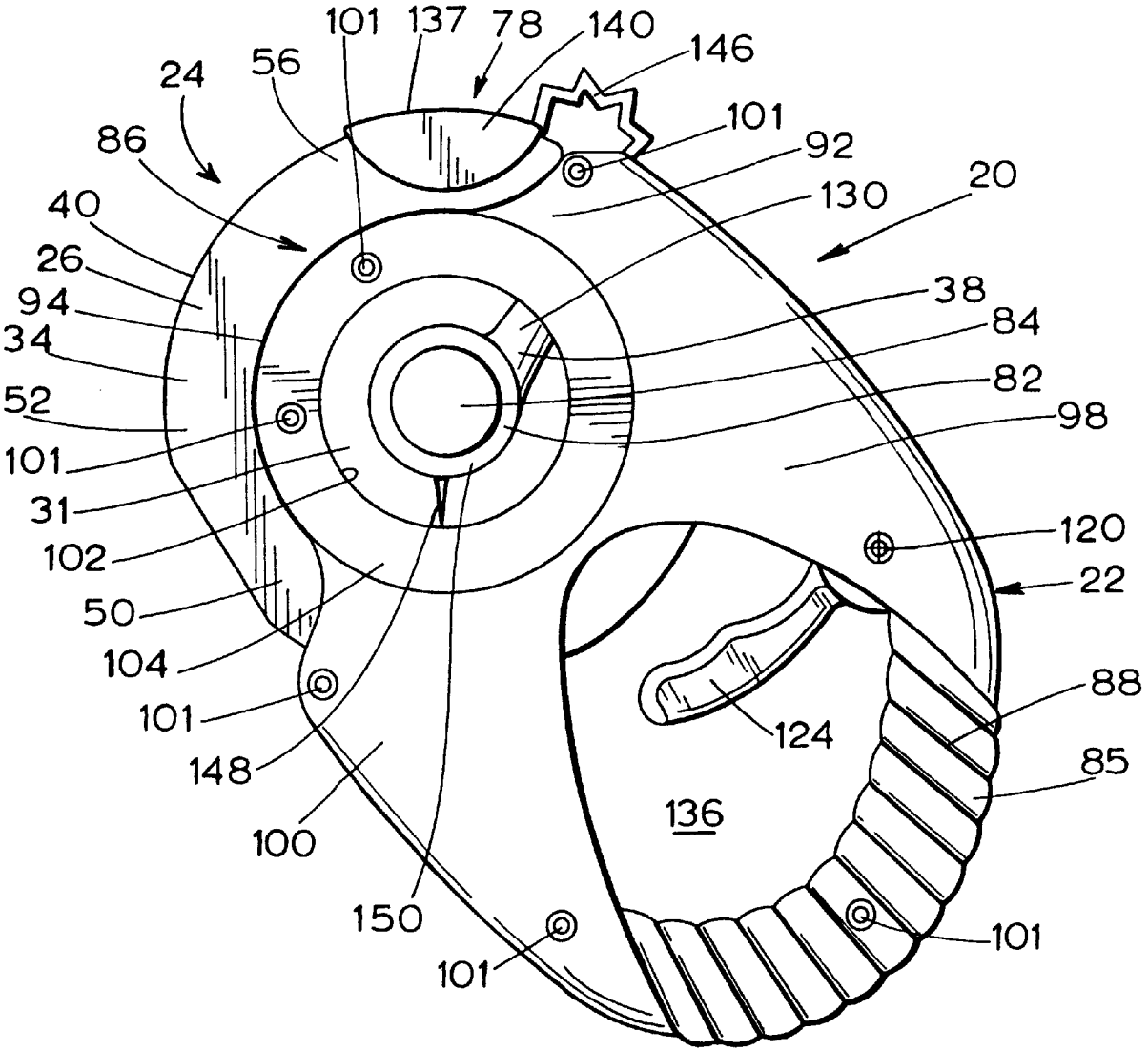
FIG. 1 is a side view of a bubble maker embodying one form of the present invention.
Figure 4:
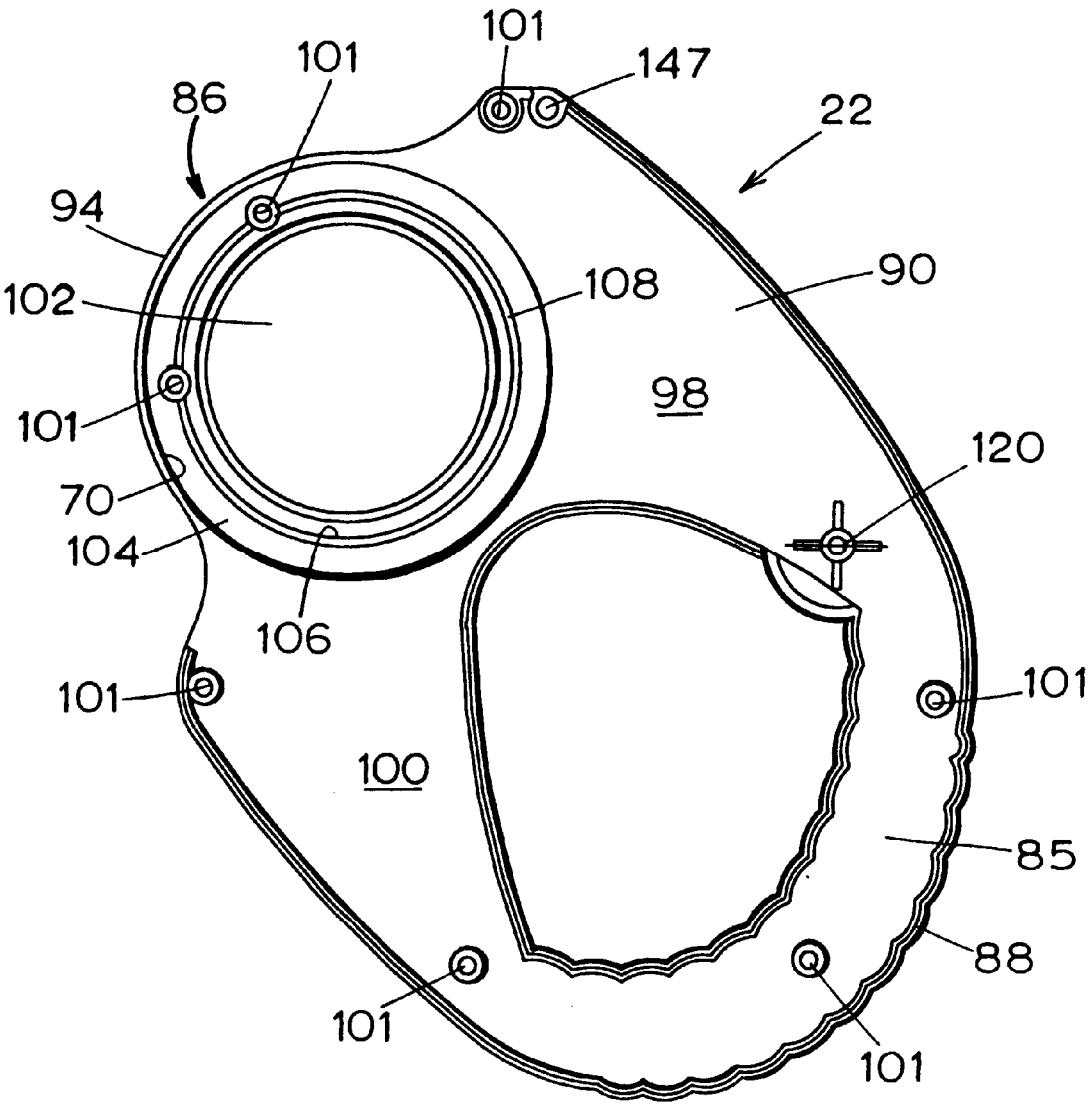
FIG. 4 is a side view of one half of the housing.
Figure 6:
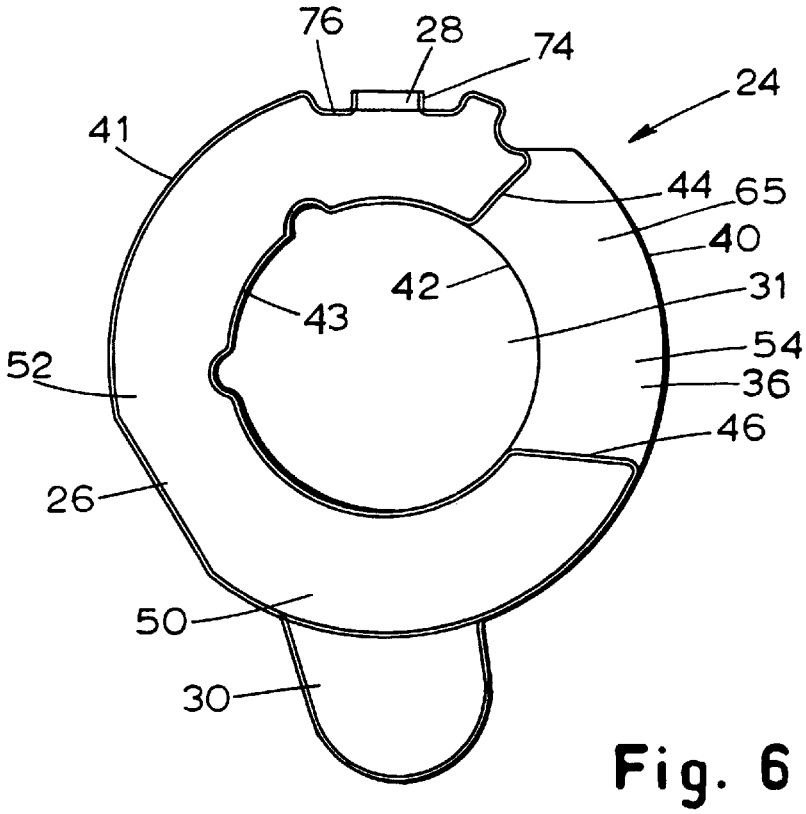
FIG. 6 is a side sectional view of the reservoir.

Referring now to the drawings, and with particular reference to FIG. 1, an embodiment of the present invention is shown as a bubble maker 20. As shown therein, the bubble maker 20 may include a handle portion 22 and a reservoir portion 24. As shown by FIGS. 4 and 6, the handle portion 22 and the reservoir portion 24 may be separately fabricated by, for example, injection molding or blow molding, and subsequently assembled together by way of, for example, a frictional coupling, or through the use of a suitable adhesive.

Figure 7:
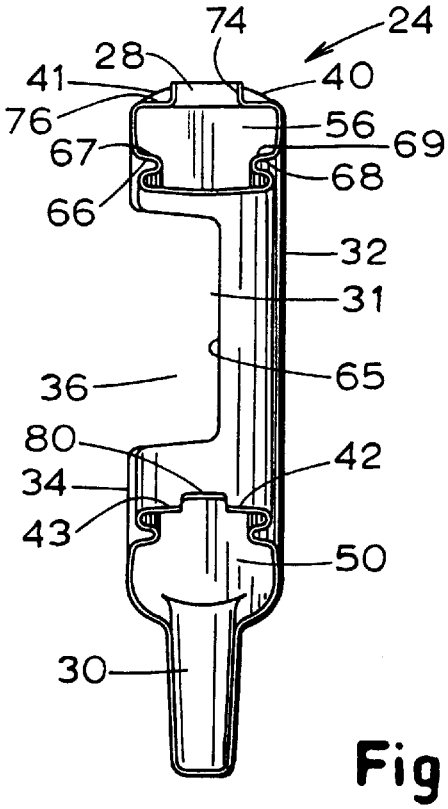
FIG. 7 is an end sectional view of FIG. 6.

With regard to the reservoir portion 24, FIGS. 6 and 7 show the reservoir portion 24 may include a substantially annular body 26 with a refill port 28 at its top, a bubble forming bay 30 at its bottom, and a central opening 31. In the depicted embodiment, while a first side 32 of the annular body 26 forms a complete circle or annulus, a second side 34 includes an angular recess 36 which accommodates the movement of a wand 38. More specifically, an outer diameter 40 and an inner diameter 42 of the first side 32 form a complete 360 degree circumference, and an outer diameter 41 and an inner diameter 43 of the second side 34 span only a partial circumference, in the depicted embodiment being approximately 270 degrees. An upper end 44 and a lower end 46 complete the reservoir on the second side 34 to facilitate fluid retention. In so doing, it will be noted, particularly from FIG. 6, that the second side 34 of the reservoir portion 24 appears to have a substantially "c" shape, as opposed to a complete ring or annular shape of the first side 32. In an alternative embodiment, a sleeve (not shown) could be provided in the reservoir 26 between the first side 32 and second side 34 to accommodate the motion of the wand 38, while enabling both sides to form complete circles. In a still further embodiment, the wand 38 could be provided with a jog (not shown) or contour such that is may move around and on the outside of a completely annular shaped reservoir (not shown).

Figure 2:
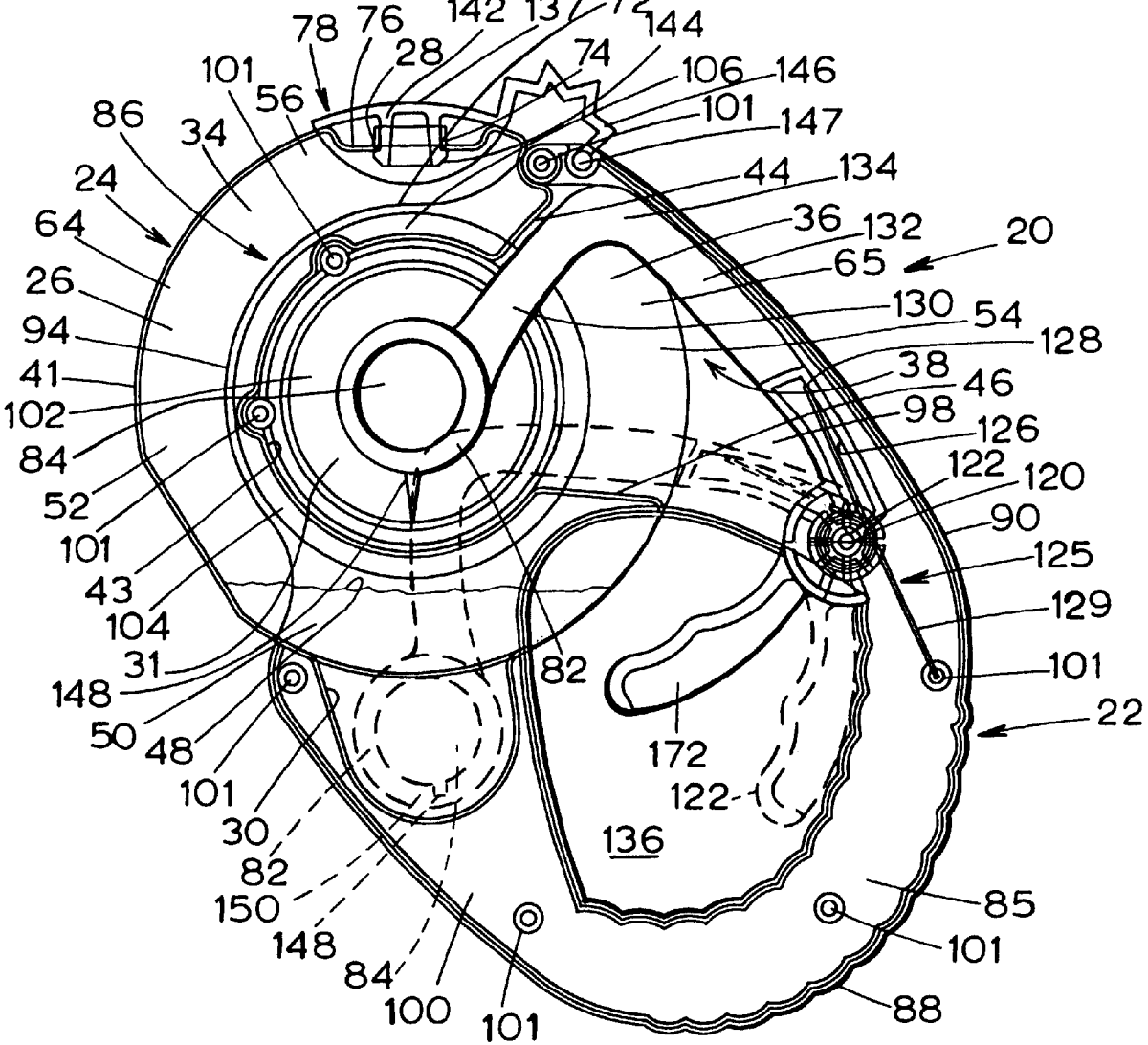
FIG. 2 is a side sectional view of FIG. 1 showing the wand in first and second positions.

It can therefore be appreciated that, as shown in FIG. 1 and 2, when the bubble maker 20 is held upright, gravity dictates that bubble forming or soapy solution 48 settles first to the bay 30, and then proceeds to fill a base 50 of the body 26 before filling sides 52, 54, and ultimately an upper region 56. The bay 30 may be provided with a width sufficiently narrow and a height sufficiently long to ensure a thin expanse of the solution 48 is provide on both sides of the wand ring 82. Since the volume of the bay 30 is therefore relatively small in comparison to the entire reservoir 26, the bubble maker 20 ensures that substantially all of the solution 48 is used.

The cross-sectional view of the reservoir 24 depicted in FIG. 7 shows that the reservoir body 26 is substantially square in cross-section, as formed by the inner diameters 42, 43, the outer diameters, 40, 41, and the first and second outer sidewalls 32, 34. A central wall 65 spans between end walls 44 and 46 in the area of the recess 36. Inwardly directed from sidewalls 32, 34 are annular grooves 66, 68 formed by curved walls 67, 69, respectively, which are adapted to mate with annular fingers 70, 72 of the handle portion 22, as will be discussed in further detail herein. Proximate upper region 56, the refill port 28 is provided as defined by an annular rim 74 which extends from flattened base 76. When the refill port 28 is closed by a cap 78, as shown in FIG. 2 and described in further detail herein, the reservoir body 26 is substantially imperforate, but for slot 80 provided in the inner diameters 42, 43 proximate base 50. It is through the slot 80 that a ring 82 of the wand 38 passes in order to gain access to the solution 34 in bay 30, and then back to central opening 31. The ring 82 defines an interior opening 84 across which the film of bubble forming solution forms.

Figure 5:
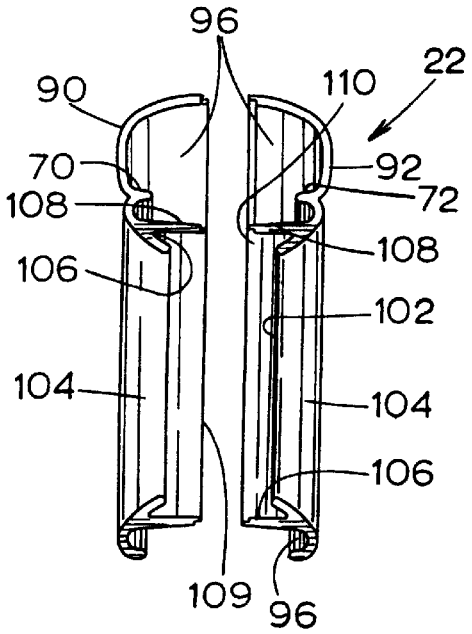
FIG. 5 is an exploded perspective view of a section of the housing and drip gutter.

Turning now to the handle portion 22, it can be seen in FIGS. 1, 2, and 4 that the handle portion 22 includes a grip 85 which is adapted to be grasped by an operator, as well as a mating end 86 which is adapted to receive the reservoir portion 24 in the aforementioned interference or adhesive fit. More specifically, the grip 85 may include a plurality of contoured undulations 88 to facilitate grasping of the handle portion 22. As shown in FIG. 5, the handle portion 22 may include first and second sides 90, 92 both having arcuate surfaces 94 and defining an opening 96 for receipt of the reservoir portion 24. Supporting planes 98, 100 extend from the mating end 86 to the grip 84, and may be integrally molded together. The first and second sides 90, 92 may be joined at a plurality of junction points 101 by suitable fasteners.

Proximate the mating end 86, it will be noted that an opening 102 is provided in each side 90 and 92, respectively. Air is passed through the central opening 102, such as by a human breath of a fan generated air stream, to form a bubble from a soapy film extended across the ring 82 and its central opening 84. Chamfered or beveled walls 104 taper the sides 90 and 92 inwardly toward openings 102.

Figure 3:
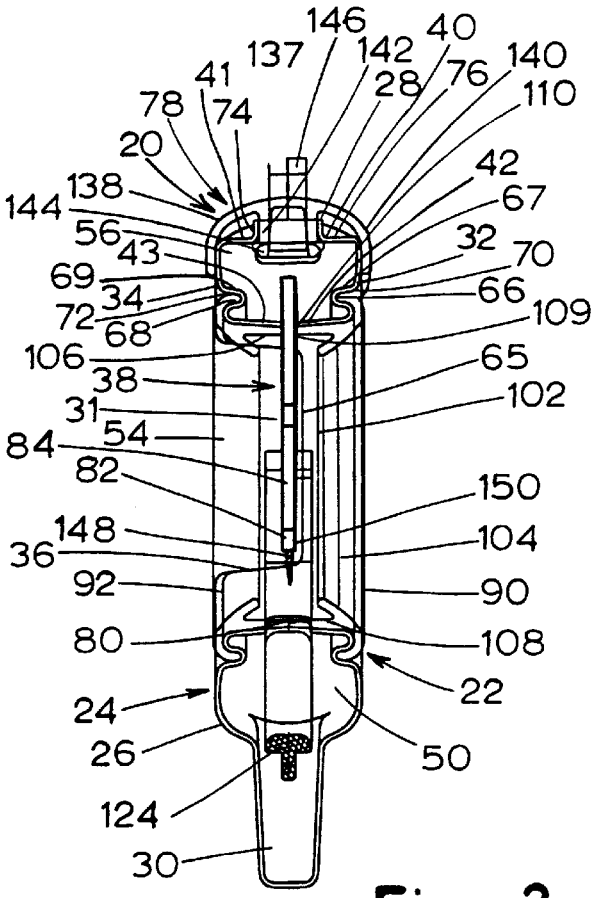
FIG. 3 is an end sectional view of FIG. 1.

As shown in FIGS. 3 and 5, the chamfered walls 104 also work in conjunction with the inner diameters 42, 43 of the reservoir body 26 to define a drip channel or gutter 106, which serves to collect excess solution from the ring 82 and thereby reduces the likelihood of the solution dripping from the bubble maker 20 or coming into contact with the operator of the bubble maker 20. Inwardly directed annular ledges 108 extend from the chamfered walls 104 to support and facilitate retention of the reservoir body 26, as shown in FIG. 3. Ledges 108 include complementary lips 109, 110 adapted to mate together as shown in FIGS. 3 and 5. Eventually, the solution gathered within the drip gutter 106 will be directed via gravity to the slot 40 and thus back into the reservoir body 24.

FIG. 2 shows that drip gutter 106 may extend around the entire inner diameters 42, 43 of the annular reservoir 26 in order to close off the drip gutter 106 and direct the solution 48 to the reservoir 26. In such an embodiment, a slot (not shown) may be provided in the drip gutter 106 to accommodate movement of the wand 38, or the slot may be an extension of the slot 80. Alternatively, the drip gutter 106 may extend only around the inner diameter 43 of the second side 34, and not extend across the recess 36. In order to seal the drip gutter at ends proximate the recess 36, suitable elastomeric dams (not shown) may be provided.

Figure 8:
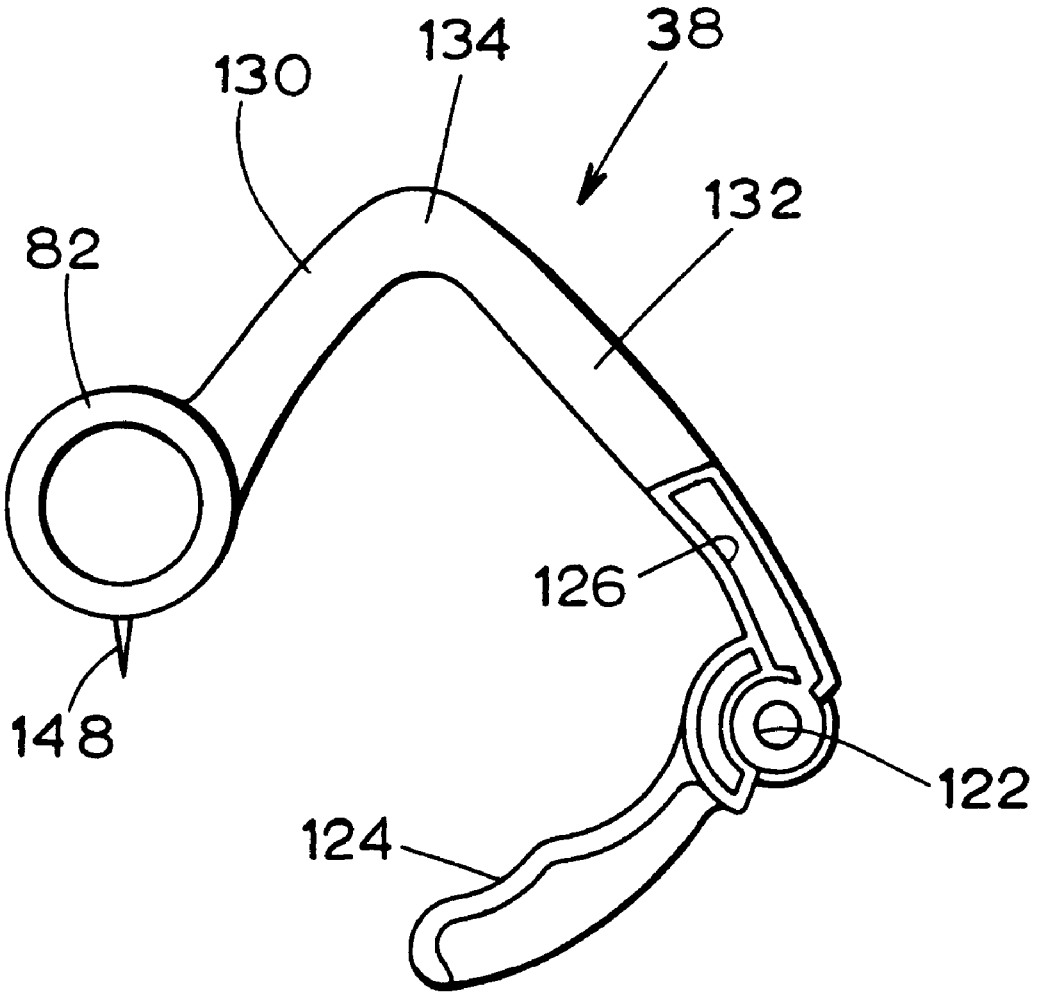
FIG. 8 is a side view of the wand.

As shown in FIG. 2, the wand 38, and accordingly the ring 82, are adapted to move from the operational position (solid lines) wherein the ring 82 is within the central opening 96, and the reload position (dashed lines) wherein the ring 82 is within the bay 30. In order to mechanize and somewhat automate the process, the wand 38 may be pivotally attached to the handle portion 22 at a pivot 120, shown in FIG. 4. As shown in FIG. 8, wand 38 may include an aperture 122 to allow wand 38 to be mounted to pivot 120. As also shown in FIG. 8, a trigger 124 may be directly coupled to the wand 38 such that movement of the trigger 124 from the outward position to the inward position proximate the grip 85 causes movement of the ring 82 from the operational position to the loading position.

To facilitate operation, a biasing mechanism, preferably a torsion spring 125 (FIG. 2), may be provided about the pivot 120 to the bias wand 38 into the operational position. The wand 38 may include a recess 126 for receipt of a first leg 128 of the torsion spring 125. A second leg 129 of the torsion spring 125 may be held against rotation by the junction point 101. To allow for this range of motion, it will be noted that the wand 38 includes a short leg 130, as well as a long leg 132 which are joined at a substantially orthogonal angle 134.

In alternative embodiments a spring bias need not be employed. For example, the trigger 124 could be equipped with a magnet (not shown) which would be attracted to another magnet (not shown) provided on the wand ring 82. Another embodiment could employ a rotatable dial with suitable gearing (not shown) to move the wand ring between positions. Such an embodiment could be provided in pendant form for hanging purposes in that a handle and trigger would not be required.

In operation, it can therefore be seen that when a user grasps the bubble maker 20 by the grip 85 and the trigger 124 through an opening 136, and squeezes the trigger 124 toward the grip 85, the wand ring 82 moves from the central opening 102 into the bay 30. In such a loading position, the solution 34 adheres to the ring 82 and upon being pulled from the reservoir 24 through the slot 80, forms a soapy film across the ring 82. In order to be removed from the reservoir 24, the user simply needs to release the trigger 124 which allows the torsion spring 125 to bias the wand 38 into the upper or operational position. The user can then either move the bubble maker 20 to cause ambient air to move toward the soapy film and thus create a bubble, or can direct a breath of air toward the soapy film to create the bubble. Either way, the bubble forming process is substantially mechanized and automated without reliance on the skill level of the operator, and results in substantially no leakage or spillage of the solution 34.

As shown in FIGS. 1–3, the refill port 28 of the reservoir body 26 is closeable in the preferred embodiment with the cap 78. The cap 78 may have a low profile so that it substantially assumes the shape of the outer circumference 40, 41 of the annular reservoir body 26 when closed. Cap 78 may include arcuate top 137 with first and second curved sides 138, 140. The refill port 28 of the reservoir body 26 may be sealed by an elastically deformable hub 142 and shoulders 144, integrally formed with the cap 78 which snap into the refill port 28 of the reservoir 24. An angled ribbon 146 may be used to connect the cap 78 to the handle portion 22 at hinge 147 (FIG. 2) to promote retention, and avoid loss of the cap 78.

One other feature which lends itself toward making the bubble maker 20 spill resistant, is provided in the form of a drip string 148. The drip string 148 may be provided in the form of a protrusion of plastic extending from the wand ring 82 into the grip gutter 106. In so doing, excess liquid draining from the ring 82 is directed to a base 150 of the ring 82, to the drip string 148, and ultimately into the drip gutter 106 and back to the reservoir 24. If not for the drip string 148, excess solution might tend to migrate along the wand 38 or simply drip from the ring 82 onto the user. While the drip string 148 may be integrally molded with the wand ring 82, it is to be understood that in alternative embodiments, separate drip strings, including monofilament lines, can be separately attached to the wand ring 82 to serve the same function. To maintain the shape and direction of the drip string 148, the bay 30 may include a complementary shaped recess (not shown) to receive the drip string 48 during each downward stroke.

From the foregoing, it will therefore be noted by one of ordinary skill in the art that the present invention provides a mechanized bubble maker with enhanced spill resistance. The annular reservoir, in combination with the single slot and the drip gutter, form a complete channel for direction of excess fluid from the wand ring back to the reservoir. Moreover, by mechanizing the dipping process for the wand, once the solution is provided within the reservoir, the user need not come in contact with the solution, and can consistently create a bubble forming film.

While the present invention is susceptible to various modifications and alternative constructions, certain illustrative embodiments thereof have been shown in the drawings and have been described herein in detail. It should be understood, however, that there is no intention to limit the invention to the specific forms disclosed, but on the contrary, the intention is to cover all modifications, alternative constructions, and equivalents falling within the spirit and scope of the invention as defined by the appended claims.

What is claimed is:

1. A manually operated, spill-resistant bubble making toy, comprising:

a housing that is shaped to enclose a substantially annularly shaped reservoir volume that surrounds a central opening, the housing having a substantially annularly shaped outer periphery surrounding the central opening, the central opening being disposed inwardly of the substantially annularly shaped outer periphery, the reservoir volume being adapted to retain bubble making solution;

a bubble forming ring pivotally attached to the housing and adapted to move from the reservoir volume to the central opening; and a trigger operably attached to the bubble forming ring to move the bubble forming ring between the reservoir volume and the central opening.

2. The manually operated, spill-resistant bubble making toy of claim 1 wherein the housing further includes a spill gutter around an inner circumference of the housing.

3. The manually operated, spill-resistant bubble making toy of claim 1 wherein the housing further includes a slot in the inner circumference of the annular reservoir adapted to allow passage of the bubble forming ring.

4. A manually operated, spill-resistant bubble making toy, comprising:

a housing having a substantially annular reservoir and a central opening, the reservoir being adapted to retain bubble making solution;

a bubble forming ring pivotally attached to the housing and adapted to move from the reservoir to the central opening; and a trigger operably attached to the bubble forming ring to move the bubble forming ring between the reservoir and the central opening;

wherein the bubble forming ring further includes a drip string adapted to direct excess bubble making solution from the ring to the reservoir.

5. A manually operated, spill resistant bubble making toy, comprising:

a housing having a substantially annular reservoir volume surrounding a central opening, the housing being adapted to retain bubble making solution in the annular reservoir volume and not in the central opening regardless of the position to which the housing is rotated;

a bubble forming ring pivotally attached to the housing and adapted to move from the reservoir volume to the central opening, the bubble forming ring being alignable with the central opening so that air may pass through the bubble ring and the central opening to form bubbles; and a trigger operably attached to the bubble forming ring to move the bubble forming ring between the reservoir volume and the central opening;

wherein the housing further includes a user engageable handle, the trigger being biased away from the handle and causing the bubble forming ring to be positioned in the central opening.

6. A manually operated, spill-resistant bubble making toy, comprising:

a housing having a substantially annular reservoir and a central opening, the reservoir being adapted to retain bubble making solution;

a bubble forming ring pivotally attached to the housing and adapted to move from the reservoir to the central opening;

a trigger operably attached to the bubble forming ring to move the bubble forming ring between the reservoir and the central opening;

a user engageable handle, the trigger being positioned away from the handle and causing the bubble forming ring to be positioned in the central opening; and a torsion spring adapted to bias the trigger away from the handle.

7. A spill-resistant bubble maker, comprising:

a housing that is shaped to enclose a substantially annular reservoir volume surrounding a central opening, the housing being rotatable to multiple positions, the reservoir volume being adapted to retain a volume of bubble making solution regardless of the position to which the housing is rotated;

first and second annular walls extending from an inner circumference of the housing toward the central opening, the first and second walls cooperating with the inner circumference to form a channel, the channel being adapted to retain bubble forming solution;

a wand having a bubble forming ring at one end and being adapted to move from a first position in the reservoir volume to a second position in the central opening; and a trigger connected to the wand for moving the wand between the first and second positions.

8. The bubble maker of claim 7 wherein the housing includes a slot in the inner circumference of the annular reservoir adapted to allow passage of the wand ring between the first and second positions.

9. A bubble maker, comprising:

a housing having a substantially annular reservoir and a central opening, the reservoir being adapted to retain a volume of bubble making solution;

a wand having a bubble forming ring at one end and adapted to move from a first position in the reservoir to a second position in the central opening;

means for moving the wand between the first and second positions;

a slot in the inner circumference of the annular reservoir adapted to allow passage of the wand ring between the first and second positions; and a drip string connected to the wand ring, the drip string adapted to extend into the channel toward the slot when the wand is in the second position.

10. The bubble maker of claim 9 wherein the wand and drip string are integrally molded together.

11. The bubble maker of claim 7 wherein the trigger is spring biased.

12. The bubble maker of claim 11 wherein the trigger is adapted to move from an outward position placing the wand ring in the second position to an inward position placing the wand ring in the first position.

13. The bubble maker of claim 12 further including a torsion spring adapted to bias the trigger into the outward position.

14. A bubble maker, comprising:

a housing having a substantially annular reservoir and a central opening, the reservoir being adapted to retain a volume of bubble making solution;

a wand having a bubble forming ring at one end and being adapted to move from the first position in the reservoir to a second position in the central opening; and a trigger for moving the wand between the first and the second positions, the trigger being adapted to move from an outward position placing the wand ring in the second position to an inward position placing the wand ring in the first position, the trigger being biased into the outward position by a torsion spring;

wherein the housing includes a handle proximate to the trigger, the handle being squeezed in conjunction with the trigger when moving the wand.

15. A bubble maker, comprising:

a housing having a substantially annularly shaped reservoir volume surrounding a central opening, the reservoir volume being adapted to retain a volume of bubble making solution;

a wand having a bubble forming ring at one end and adapted to move from a first position in the reservoir to a second position in the central opening; and a trigger for moving the wand between the first and second positions;

wherein the housing further includes a reduced volume bay in fluid communication with the reservoir volume and defining the first position for the wand.

16. A manually operated bubble maker, comprising:

a housing shaped to enclose an annular reservoir volume adapted to retain a volume of bubble making solution, the annular reservoir volume surrounding a central opening;

an annular drip gutter extending around an inner circumference of the housing in a direction toward the central opening and away from the annular reservoir volume;

a wand having a bubble forming end and being adapted to move from a first position in the reservoir volume to a second position out of the reservoir; and a trigger operably connected to the wand and being adapted to move the wand from the first position to the second position.

* * * * *